US010248063B2

(12) United States Patent
Nakamichi

(10) Patent No.: US 10,248,063 B2
(45) Date of Patent: Apr. 2, 2019

(54) IMAGE FORMING SYSTEM, CONTROL METHOD FOR IMAGE FORMING SYSTEM, AND NON-TRANSITORY COMPUTER-READABLE STORAGE MEDIUM STORING CONTROL PROGRAM

(71) Applicant: Konica Minolta, Inc., Chiyoda-ku, Tokyo (JP)

(72) Inventor: Motoki Nakamichi, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 234 days.

(21) Appl. No.: 15/440,159

(22) Filed: Feb. 23, 2017

(65) Prior Publication Data

US 2017/0269529 A1 Sep. 21, 2017

(30) Foreign Application Priority Data

Mar. 15, 2016 (JP) ..... 2016-051435

(51) Int. Cl.
*G03G 15/00* (2006.01)

(52) U.S. Cl.
CPC ..... *G03G 15/5062* (2013.01); *G03G 15/5012* (2013.01); *G03G 15/55* (2013.01);
(Continued)

(58) Field of Classification Search
CPC ..... G03G 15/5602
(Continued)

(56) References Cited

U.S. PATENT DOCUMENTS

2004/0136745 A1* 7/2004 Sato ..... G03G 15/655 399/82
2006/0145414 A1* 7/2006 Yokobori ..... G03G 15/5012 271/258.01

(Continued)

FOREIGN PATENT DOCUMENTS

CN 1787593 A 6/2006
EP 1 666 980 A2 6/2006

(Continued)

OTHER PUBLICATIONS

Extended European Search Report dated Jul. 19, 2017, issued by the European Patent Office in corresponding European Application No. 17156805.8. (7 pages).

(Continued)

*Primary Examiner* — Anthony H Nguyen
(74) *Attorney, Agent, or Firm* — Buchanan Ingersoll & Rooney PC

(57) ABSTRACT

In a case where conveyance abnormality of a sheet has occurred on a conveyance passage in course of execution of a print job which uses sheets included in a sheet set including a plurality of sheets with sequentiality stored in a first sheet feed tray and discharges a sheet having been subjected to image formation to a first discharge section of the plurality of discharge sections, conveyance of a causal sheet having caused the conveyance abnormality is stopped, and sheets having been being conveyed on the conveyance passage on an upstream side than the causal sheet are discharged to other discharge section other than the first discharge section. Thereafter, continuously, sheets located before a sheet to be fed first at a time of performing recovery printing after elimination of conveyance abnormality, are fed from the first sheet feed tray, and discharged the sheets to the other discharge section.

9 Claims, 12 Drawing Sheets

(52) U.S. Cl.
CPC ..... *G03G 15/6552* (2013.01); *G03G 15/70* (2013.01); *G03G 2215/00523* (2013.01); *G03G 2215/00552* (2013.01); *G03G 2215/00894* (2013.01)

(58) Field of Classification Search
USPC ..... 399/16
See application file for complete search history.

(56) References Cited

U.S. PATENT DOCUMENTS

| | | | | |
|---|---|---|---|---|
| 2008/0174626 | A1* | 7/2008 | Hirao | B41J 11/006 347/16 |
| 2009/0232522 | A1* | 9/2009 | Takahashi | G03G 15/5012 399/19 |
| 2010/0252984 | A1* | 10/2010 | Maeda | G03G 15/655 270/58.23 |
| 2012/0286465 | A1* | 11/2012 | Ooba | B65H 3/44 271/9.01 |

FOREIGN PATENT DOCUMENTS

| | | | |
|---|---|---|---|
| JP | 2004-117970 | A | 4/2004 |
| JP | 2004-174895 | A | 6/2004 |
| JP | 2009-222794 | A | 10/2009 |

OTHER PUBLICATIONS

Office Action dated Sep. 20, 2018, by the Chinese Patent Office in corresponding Chinese Patent Application No. 201710147814.1 and English translation of the Office Action. (13 pages).

* cited by examiner

SINGLE SET OF TABS (FIVE TABS)
(SHEET SET INCLUDING A PLURALITY
OF SHEETS WITH SEQUENTIALITY)

SHEET FEED TRAY
(A PLURALITY OF SHEET
SETS OF TAB SHEETS)

FIRST SHEET FEED TRAY

OTHER SHEET FEED TRAY

PRINTED MATTER
(PRINT DATA A TO G, AND LABEL IMAGE DATA 1 TO 5)

IMAGE FORMING SYSTEM, CONTROL METHOD FOR IMAGE FORMING SYSTEM, AND NON-TRANSITORY COMPUTER-READABLE STORAGE MEDIUM STORING CONTROL PROGRAM

CROSS-REFERENCE TO RELATED APPLICATION

This application is based on Japanese Patent Application No. 2016-51435 filed on Mar. 15, 2016, the contents of which are incorporated herein by reference.

BACKGROUND

1. Technical Field

The present invention relates to an image forming system, a control method for an image forming system, and a non-transitory computer readable storage medium storing a control program.

2. Description of Related Arts

In image forming systems, there is a case where a printed matter is produced such that tab sheets on each of which a tab is disposed at a position different from other tabs are inserted separately between printed pages. Such tab sheets have sequentiality. Accordingly, in the case where conveyance abnormality, such as a sheet jam, has occurred in course of production of a printed matter with the tab sheets, it is necessary to align the order of the tab sheets before performing the next printing.

In a printing system disclosed in JP 2009-222794A, in the case where printing has been suspended due to conveyance abnormality of a sheet while tab sheets have been used, a removal operation is performed so as to remove tab sheets having remained in a sheet feeding section. With this, it becomes possible to prevent tab sheets with out of order from remaining and being printed without noticing this situation. However, in the case where a discharge tray to which tab sheets are discharged by the removal operation for the tab sheets and a discharge tray to which normal printed matters are discharged in recovery printing executed after elimination of conveyance abnormality are set to the same discharge tray, the unnecessary tab sheets are mixed between the normal printed matters. In order to prevent this problem, it is necessary to set their discharge destinations to the respective separate discharge trays.

In the case of setting to the respective separate discharge trays, when recovery printing processing is performed subsequently to discharge of tab sheets by processing of the removal operation, a switching operation for discharge trays needs to be performed between the recovery printing processing and the processing of the removal operation. For this reason, there has been a need to provide a waiting time more than a predetermined time between the recovery printing processing and the processing of the removal operation.

Due such a switching operation, it is necessary to take countermeasures, such as providing a waiting time, slowing a conveyance speed of subsequent sheets, and widening a distance between sheets.

SUMMARY

The present invention has been achieved in view of the above-mentioned circumstances, and in the case where conveyance abnormality has occurred in course of execution of a print job which uses a sheet set including a plurality of sheets with sequentiality like tab sheets, an object of the present invention is to perform recovery printing efficiently with sheets included in a subsequent sheet set including a plurality of sheets with sequentiality.

To achieve at least the abovementioned object, an image forming system reflecting one aspect of the present invention, comprises a sheet feeding section which includes a plurality of sheet feed trays each of which stores a plurality of sheets, and feeds sheets stored in the sheet feed tray one sheet by one sheet; a conveyance section which includes a conveyance passage, and conveys a sheet fed from the sheet feeding section on the conveyance passage; an image forming section which forms an image on a conveyed sheet; a plurality of discharge sections each of which discharges a sheet having been subjected to image formation; and a processor configured such that in a case where a plurality of sheet sets each including a plurality of sheets with sequentiality are stored in a first sheet feed tray of the plurality of sheet feed trays, and in a case where conveyance abnormality of a sheet has occurred on the conveyance passage in course of execution of a print job which uses sheets included in the sheet set and discharges a sheet having been subjected to image formation to a first discharge section of the plurality of discharge sections, the processor stops conveyance of a causal sheet having caused the conveyance abnormality, and discharges sheets having been being conveyed on the conveyance passage on an upstream side than the causal sheet to other discharge section other than the first discharge section, and thereafter, continuously, the processor feeds sheets located, in the sheet set, before a sheet to be fed first at a time of performing recovery printing after elimination of conveyance abnormality, from the first sheet feed tray, and discharges the sheets to the other discharge section.

The objects, features, and characteristics of this invention other than those set forth above will become apparent from the description given herein below with reference to preferred embodiments illustrated in the accompanying drawings.

DETAILED DESCRIPTION

Figure 1:
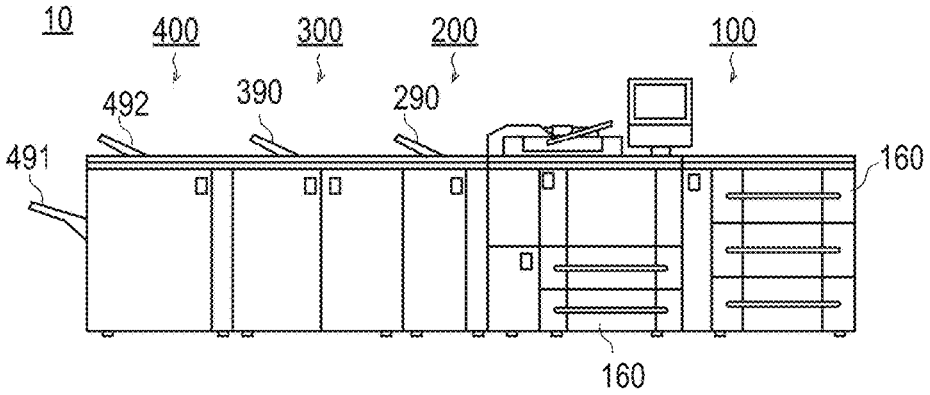
FIG. 1 is a front view showing an external appearance of an image forming system according to one embodiment of the present invention.

Hereinafter, an embodiment of the present invention will be described with reference to the attached drawings. In the description of the drawings, the same sign is given to the same element, and an overlapping description is omitted. Since a dimension ratio in the drawings is exaggerated on account of description, the ratio may be different from the actual ratio.

Figure 2:
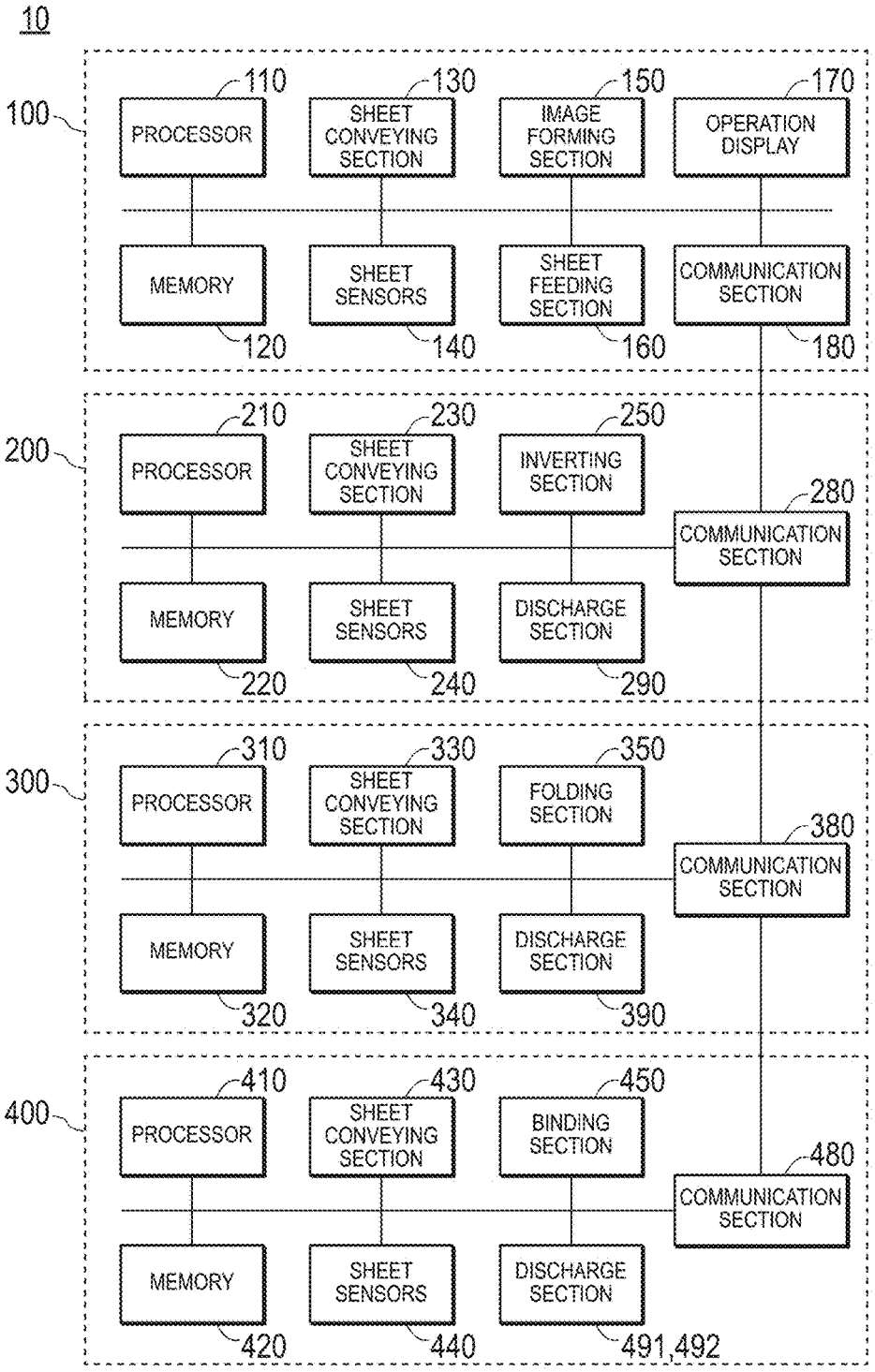
FIG. 2 is a block diagram showing a hardware constitution of an image forming system.

FIG. 1 is a front view showing an external appearance of an image forming system according to one embodiment of the present invention. FIG. 2 is a block diagram showing a hardware constitution of the image forming system.

As shown in FIG. 1 and FIG. 2, an image forming system 10 includes an image forming apparatus 100, an inversion conveyance apparatus 200, a folding apparatus 300, and a binding apparatus 400. Furthermore, discharge sections 290, 390, 491, and 492 to which sheets having been subjected to printing etc. are discharged, are disposed in the inversion conveyance apparatus 200, the folding apparatus 300, and the binding apparatus 400, respectively.

The image forming apparatus 100 forms images on sheets. The inversion conveyance apparatus 200 inverts the front and back surfaces of a sheet conveyed from the image forming apparatus 100. The folding apparatus 300 applies folding processing for sheets conveyed from the inversion conveyance apparatus 200. The binding apparatus 400 applies side stitching processing with stapling etc. for sheets conveyed from the folding apparatus 300. Hereinafter, respective constitutions are described.

(Image Forming Apparatus 100)

The image forming apparatus 100 includes a processor 110, a memory 120, a sheet conveying section 130, sheet sensors 140, an image forming section 150, a sheet feeding section 160, an operation display 170, and a communication section 180, and these components are connected with each other via signal lines, such as buses for exchanging signals.

The processor 110 is a CPU, and performs control for each of the above sections and various kinds of arithmetic processing in accordance with programs.

The memory 120 includes a ROM which stores various kinds of programs and various kinds of data beforehand, a RAM which stores a program and data temporarily as a working region, a hard disk which stores various kinds of programs and various kinds of data, and so on.

The sheet conveying section 130 conveys sheets to be used for printing. Sheets conveyed from the sheet feeding section 160 are conveyed one sheet by one sheet to the image forming section 150 along a conveyance passage in the image forming apparatus 100.

The sheet sensor 140 are, for example, two or more optical sensors disposed on required portions of the conveyance passage. Each of the sheet sensors 140 detects at its disposed position that a sheet exists on the conveyance passage (or a sheet does not exist), and notifies detection results to the processor 110. In the case where a sheet exists or does not exist at the respective detecting positions of the sheet sensors 140 at a predetermined timing, the processor 110 determines that conveyance abnormality, such as a jam, has occurred.

The image forming section 150 forms images on sheets based on various kinds of data with a well-known image forming process such as an electrophotography type process including respective processes of electrostatic charging, exposing, developing, transferring, and fixing.

The sheet feeding section 160 includes a plurality of sheet feed trays. The sheet feeding section 160 feeds sheets stored in a sheet feed tray one sheet by one sheet to the sheet conveying section 130.

The operation display 170 includes a touch panel, a ten key, a start button, a stop button, etc., and is used to display various kinds of information and to input various kinds of instructions. A user can set sheet information, such as the size and kind of sheets stored in each of the sheet feed trays via the operation display 170. Moreover, in the case where conveyance abnormality, such as a jam, has occurred, in order to urge a user to remove a sheet (hereinafter, referred to as "a causal sheet") which has caused the conveyance abnormality, the operation display 170 displays images and messages showing the position of a jam and a removal procedure as conveyance abnormality relevant information on its display surface.

The communication section 180 is an interface for communicating with other apparatuses. The communication section 180 transmits and receives various kinds of settings, various kinds of information required for operation timing control, sheet detection information by the sheet sensors 140, information showing occurrence of a jam, and the like to and from the inversion conveyance apparatus 200, the folding apparatus 300, and the binding apparatus 400.

The processor 110 controls the sheet conveying section 130 so as to convey sheets on the conveyance passage of the image forming apparatus 100. Moreover, the processor 110 detects a jam having occurred in the image forming apparatus 100 based on detection results for sheets by the sheet sensors 140 functioning as a conveyance abnormality detecting section. The processor 110 acquires, for example, the time from when the sheet sensors 140 has detected a leading end of a sheet to when the sheet sensors 140 detects a trailing end of the sheet as a sheet passage time. In the case where the acquired sheet passage time deviates from a timing set beforehand, the processor 110 determines that a jam (conveyance abnormality) has occurred.

In the case where a jam has occurred in the image forming apparatus 100 or the other apparatuses 200, 300, or 400, the processor 110 stops conveyance of sheets temporarily in the image forming apparatus 100 in order to prevent occurrence of additional jams. Moreover, the processor 110 transmits information showing occurrence of the jam to the other apparatuses, and makes conveyance of sheets stop also in the other apparatuses. Moreover, in the case where a jam has occurred, the processor 110 performs purge processing so as to conveys automatically sheets, except the causal sheet, having been being conveyed on a conveyance passage in each of the image forming apparatus 100 and the other apparatuses (the inversion conveyance apparatus 200, the folding apparatus 300, and binding apparatus 400), and to discharge the sheets to any of discharge sections of the image forming systems 10. In the present embodiment, the purge processing is performed after the causal sheet has been removed by a user and the conveyance abnormality has been eliminated. However, the purge processing is performed also before the causal sheet is removed, depending on the position of the causal sheet. The purge processing performed before a causal sheet is removed is called in particular "pre-purge processing". In the pre-purge processing, the processor 110 stops a driving motor for conveyance roller pairs which have been conveying a causal sheet when a jam has occurred, and in addition, conveys sheets having been being conveyed on a conveyance passage on an upstream side of the causal sheet, to a discharge section. In the case of the pre-purge processing, it is preferable to control so as to convey sheets located on an upstream side than the causal sheet to the discharge section without having never stopped the sheets.

(Inversion Conveyance Apparatus 200)

The inversion conveyance apparatus 200 includes a processor 210, a memory 220, a sheet conveying section 230, sheet sensors 240, an inverting section 250, a communication section 280, and a discharge section 290, and these components are connected with each other via signal lines, such as buses. The processor 210, the memory 220, the sheet conveying section 230, the sheet sensors 240, and the communication section 280 have the similar functions with the processor 110, the memory 120, the sheet conveying section 130, the sheet sensors 140, and the communication section 180 of the image forming apparatus 100, respectively. Then, in order to avoid duplication of a description, a description for all or a part of them is omitted.

The processor 210 performs control for the above respective constitution components, various kinds of arithmetic processing, and the like in accordance with programs. Based on instructions from the processor 110 of the image forming apparatus 100, the processor 210 controls the sheet conveying section 230, the inverting section 250, and the discharge section 290 so as to perform respective controls of conveyance, inversion, and discharge for sheets.

The sheet conveying section 230 conveys sheets conveyed from the image forming apparatus 100 along a conveyance passage in the inversion conveyance apparatus 200. The sheet conveying section 230 conveys sheets to the inverting section 250 based on print setting of a print job. When a sheet is conveyed in the inverting section 250, the front and back surfaces of the sheet are inverted.

The processor 210 detects a jam having occurred in the inversion conveyance apparatus 200 based on detection results for sheets by the sheet sensors 240. In the case where the processor 210 has detected a jam, the processor 210 controls the sheet conveying section 230 so as to stop conveyance of sheets within the inversion conveyance apparatus 200. Moreover, the processor 210 transmits information showing occurrence of the jam in the inversion conveyance apparatus 200 to the image forming apparatus 100 via the communication section 280.

The discharge section 290 may serve as a discharge destination at the time of purge processing executed in the case where a jam has occurred in the conveyance passage of the image forming system 10.

(Folding Apparatus 300)

The folding apparatus 300 includes a processor 310, a memory 320, a sheet conveying section 330, sheet sensors 340, a folding section 350, a communication section 380, and a discharge section 390, and these components are connected with each other via signal lines, such as buses. The processor 310, the memory 320, the sheet conveying section 330, the sheet sensors 340, and the communication section 380 have the similar functions with the processor 110, the memory 120, the sheet conveying section 130, the sheet sensors 140, and the communication section 180 of the image forming apparatus 100, respectively. Then, in order to avoid duplication of a description, a description for all or a part of them is omitted.

The processor 310 performs control for the above respective constitution components, various kinds of arithmetic processing, and the like in accordance with programs. Based on instructions from the processor 110 of the image forming apparatus 100, the processor 310 controls the sheet conveying section 330, the folding section 350, and the discharge section 390 so as to perform respective controls of conveyance, folding processing, and discharge for sheets.

The sheet conveying section 330 conveys sheets conveyed from the inversion conveyance apparatus 200 along a conveyance passage in the folding apparatus 300. The sheet conveying section 330 conveys sheets to the folding section 350 based on print setting of a print job.

The folding section 350 executes folding processing such as folding in the middle at a predetermined position and folding in three, for one or more sheets.

The discharge section 390 may serve as a discharge destination at the time of purge processing executed in the case where a jam has occurred in the conveyance passage of the image forming system 10.

The processor 310 detects a jam having occurred in the folding apparatus 300 based on detection results for sheets by the sheet sensors 340. In the case where the processor 310 has detected a jam, the processor 310 controls the sheet conveying section 330 so as to stop conveyance of sheets within the folding apparatus 300. Moreover, the processor 310 transmits information showing occurrence of the jam in the folding apparatus 300 to the image forming apparatus 100 via the communication section 380.

(Binding Apparatus 400)

The binding apparatus 400 includes a processor 410, a memory 420, a sheet conveying section 430, sheet sensors 440, a binding section 450, a communication section 480, and discharge sections 491 and 492, and these components are connected with each other via signal lines, such as buses. The processor 410, the memory 420, the sheet conveying section 430, the sheet sensors 440, and the communication section 480 have the similar functions with the processor 110, the memory 120, the sheet conveying section 130, the sheet sensors 140, and the communication section 180 of the image forming apparatus 100, respectively. Then, in order to avoid duplication of a description, a description for all or a part of them is omitted.

The processor 410 performs control for the above respective constitution components, various kinds of arithmetic processing, and the like in accordance with programs. Based on instructions from the processor 110 of the image forming apparatus 100, the processor 410 controls the sheet conveying section 430 and the binding section 450 so as to perform respective controls of conveyance, side stitching processing, and discharge for sheets.

The sheet conveying section 430 conveys sheets conveyed from the folding apparatus 300 along a conveyance passage in the binding apparatus 400. The sheet conveying section 430 conveys sheets to the binding section 450 based on print setting of a print job.

The binding section 450 performs stapling at positions located away with a predetermined distance from an end of a bundle of sheets, whereby the bundle of sheets is subjected to side stitching so as to form a booklet.

The discharge section 491 sends out a printed matter having been subjected to post processing, such as side stitching, to the outside of the binding apparatus 400, and places it on a sheet delivery tray. The discharge section 492 may serve as a discharge destination at the time of purge processing executed in the case where a jam has occurred in the conveyance passage of the image forming system 10. The processor 410 detects a jam having occurred in the binding apparatus 400 based on detection results for sheets by the sheet sensors 440. In the case where the processor 410 has detected a jam, the processor 410 controls the sheet conveying section 430 so as to stop conveyance of sheets within the binding apparatus 400. Moreover, the processor 410 transmits information showing occurrence of the jam in the binding apparatus 400 to the image forming apparatus 100 via the communication section 480.

(Conveyance Passages of the Image Forming System 10)

Figure 3:
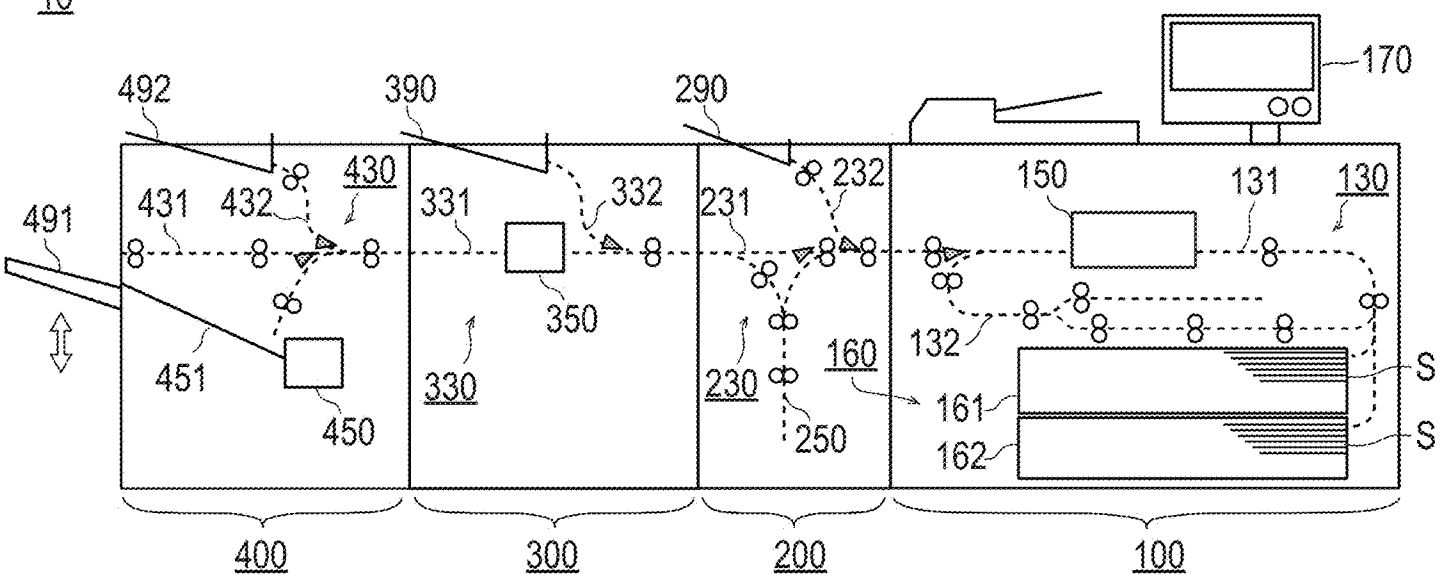
FIG. 3 is an illustration showing a cross sectional view of a whole image forming system.

FIG. 3 is an illustration showing a cross sectional view of the whole image forming system.

As shown in FIG. 3, in the inside of the image forming system 10, a plurality of conveyance passages are disposed. The sheet feeding section 160 of the image forming apparatus 100 includes a plurality of sheet feed trays 161 and 162. The sheet conveying section 130 includes conveyance passages 131 and 132, a plurality of conveyance roller pairs, and a drive unit (not shown) including a plurality of drive motors to drive the respective conveying roller pair, and so on. Similarly, the sheet conveying section 230 of the inversion conveyance apparatus 200 includes conveyance passages 231 and 232, a plurality of conveying roller pairs, and a drive unit (not shown) to drive these conveying roller pairs. The sheet conveying section 330 of the folding apparatus 300 includes conveyance passages 331 and 332, a plurality of conveying roller pairs, and a drive unit (not shown) to drive these conveying roller pairs. The sheet conveying section 430 of the binding apparatus 400 includes conveyance passages 431 and 432, a plurality of conveying roller pairs, and a drive unit (not shown) to drive these conveying roller pairs.

A sheet S fed from the sheet feed tray 161 or the sheet feed tray 162 is conveyed on the conveyance passage 131, and then is subjected to image formation in the image forming section 150. Thereafter, the sheet S is conveyed to a downstream side and further to the inversion conveyance apparatus 200, the folding apparatus 300, and the conveyance passages 231, 331, and 431 in the binding apparatus 400 in this order. Successively, the sheet S is subjected to post processing required in accordance with print settings of a print job, and then is discharged as a printed matter to the discharge section 491. The discharge section 491 is able to move a discharge tray in a vertical direction shown with an arrow in FIG. 3 in response to the height of sheets placed on the discharge tray. In the case of forming images on both sides of a sheet S, an image is formed on one side surface of the sheet S by the image forming section 150, and then the sheet S is conveyed to a both side image formation conveyance passage 132 disposed in a lower portion via a switch gate (in FIG. 3, each switch gate is shown with a triangular shape). After the front and back surfaced of the sheet S are inverted by the both side image formation conveyance passage 132, the sheet S is conveyed again to the image forming section 150, whereby an image is formed on another side surface of the sheet S.

In the case of discharging the sheet S to the discharge section 290 of the inversion conveyance apparatus 200, the sheet S is led to a branch conveyance passage 232 via a switch gate. Similarly, in the case of discharging the sheet S to the discharge section 390 of the folding apparatus 300, the sheet S is led to a branch conveyance passage 332 via a switch gate. In the case of discharging the sheet S to the discharge section 492 of the binding apparatus 400, the sheet S is led to a branch conveyance passage 432 via a switch gate.

(A Sheet Set Including a Plurality of Sheets with Sequentiality)

Figure 4A:
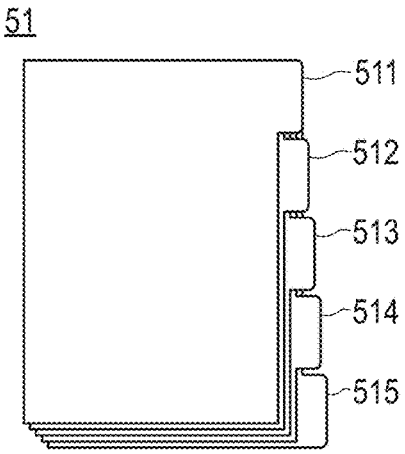
FIGS. 4A and 4B each is an illustration showing an example of tab sheets.
Figure 4B:
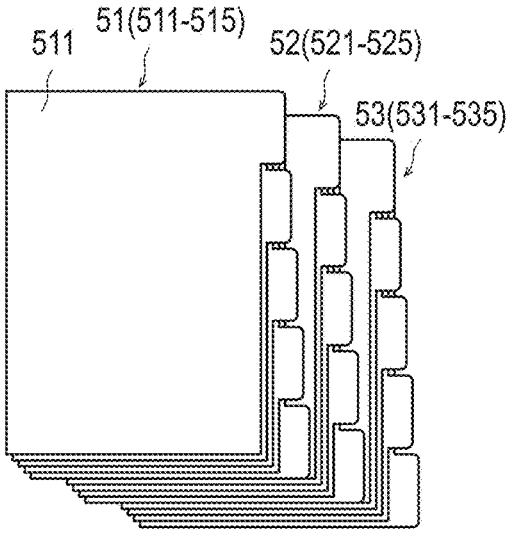

Hereinafter, a sheet set of tab sheets is described as an example of a sheet set including a plurality of sheets with sequentiality. FIG. 4A is an illustration showing an example of tab sheets (also called index sheets). FIG. 4A shows a sheet set 51 including five sheets with sequentiality. Each of five tab sheets 511 to 515 which constitute one sheet set 51, includes a rectangular main body (for example, an A4-type fixed size) and a protruding tab which is disposed on one side of the main body at a position different from the respective positions of the other tabs. The alignment sequence of the tab sheets shown in FIG. 4A is called a forward direction (normal sequence). In the case where the tabs are located at the right side of the respective main bodies, the tab sheets are aligned in such an order that a tab of an upper layer is positioned upper than a tab of a lower layer in FIG. 4A. FIG. 4B is a schematic diagram showing a plurality of sheet sets of tab sheets stored in a sheet feed tray of the image forming apparatus 100. FIG. 4B shows a state where three sheet sets 51 to 53 each including five tab sheets with sequentiality are stored in a sheet feed tray. In the case where three sheet sets 51 to 53 are stored in the sheet feed tray in the above state, the sheet feeding section 160 feeds sheets one sheet by one sheet in the order from the uppermost tab sheet 511.

Figure 5:
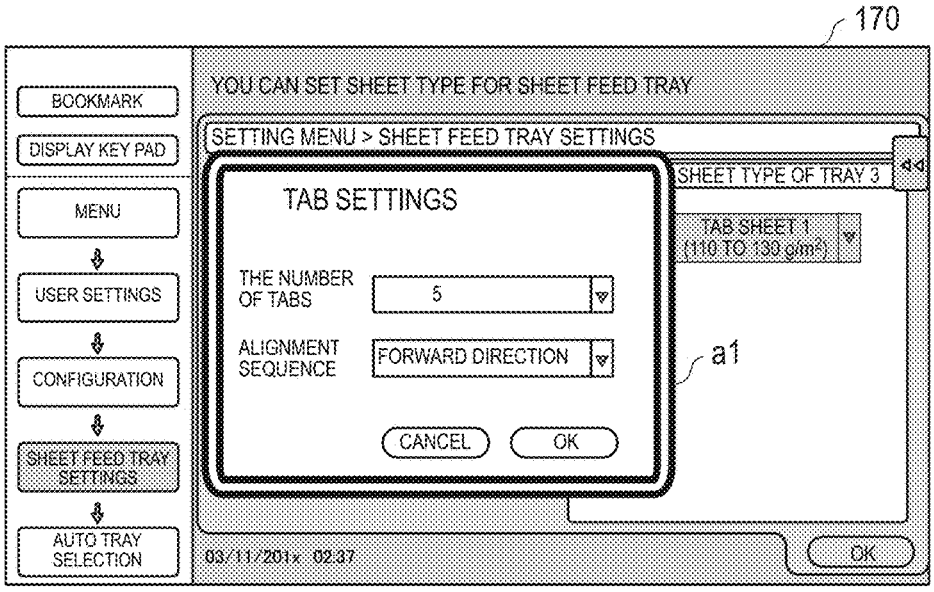
FIG. 5 is an illustration showing a setting screen used to set information on sheets stored in a sheet feed tray.

FIG. 5 is an illustration showing a setting screen which is displayed on the operation display 170 and used to set sheet information on sheets stored in a sheet feed tray. In the case of selecting a tab sheet as the kind of sheets stored in a specific sheet feed tray, a user can set the number of tabs included in one sheet set and the alignment sequence of the tabs by operating respective pulldown buttons on a setting screen al made to pop up. These settings of the sheet information are stored in the memory 120. In the case of executing a print job, the stored sheet information is read out in response to the selected sheet feed tray. The processor 110 calculates the position of the tab of each tab sheet in response to this sheet information. Successively, in the case where a print setting of a print job is set so as to form an image on a tab, the processor 110 controls to form an image corresponding to the calculated position of the tab. In an example shown in FIG. 5, with regard to the width (in a transverse direction in FIG. 4A) and length (in a longitudinal direction in FIG. 4A) of each tab, default values corresponding to a sheet kind are used for them. However, the width and length may be made to be set individually from the setting screen.

Figure 6A:
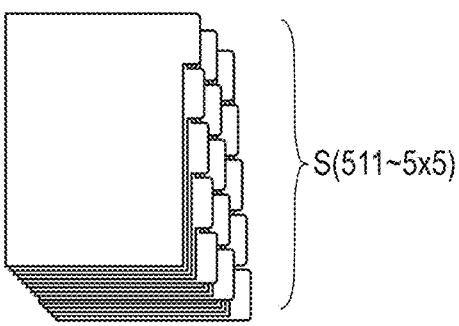
FIGS. 6A, 6B, and 6C each is an illustration showing an example of a printed matter including tab sheets.
Figure 6B:
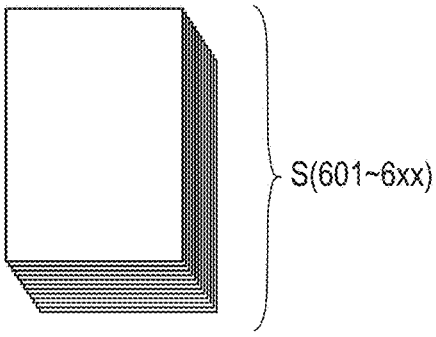
Figure 6C:
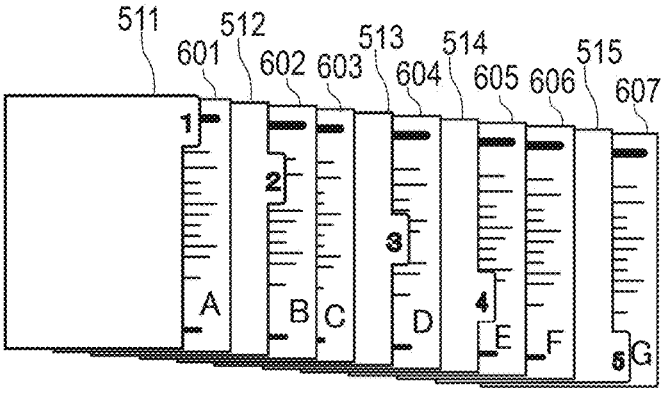

FIGS. 6A to 6C are illustrations showing an example of a printed matter including tab sheets. FIG. 6A shows tab sheets 511 to 5×5 in x sheet sets (herein, "x" represents an integer from 0 to 9) stored in a first sheet feed tray. These tab sheets correspond to the tab sheets shown in FIG. 4B. FIG. 6B shows sheets 601 to 6*xx* stored in the other sheet feed tray. All of the sheets 601 to 6*xx* are identical sheets, for example, white sheets with a fixed sheet size (for example, an A4-type fixed sheet size). Hereinafter, a description is made on the assumption that the size of a main body, except a tab, of each of the tab sheets 511 to 5×5 is the same as the size of each of the sheets 601 to 6*xx*. Image data A to G included in a print job are used for image formation for the sheets 601 to 6*xx* stored in the other sheet feed tray. On the other hand, label image data 1 to 5 each showing a division mark like a chapter are used for image formation for the respective tabs of the tab sheets 511 to 5×5 stored in the first sheet feed tray.

FIG. 6C is an illustration showing an example of a printed matter in the case of being printed normally. Image formation has been performed for a tab sheet 511 to a sheet 607 in the order shown in FIG. 6C, and then prescribed post processing has been applied for them. Thereafter, a printed matter shown in FIG. 6C is discharged to any one of the discharge sections (290, 390, 491, and 492) in response to print settings of a print job. As shown in FIG. 6C, for example, the label images 1 to 5 which show a chapter are printed on the respective tabs of the tab sheets 511, 512, 513, 514, and 515, and images A to G are printed on the sheets 601 to 607 respectively. Hereinafter, a description is given to purge processing and cueing processing of tab sheets performed in the case where conveyance abnormality, such as a jam, has occurred in course of production of the printed matter shown in FIG. 6C.

(Operation of the Image Forming System 10 when Conveyance Abnormality has Occurred)

Figure 7:
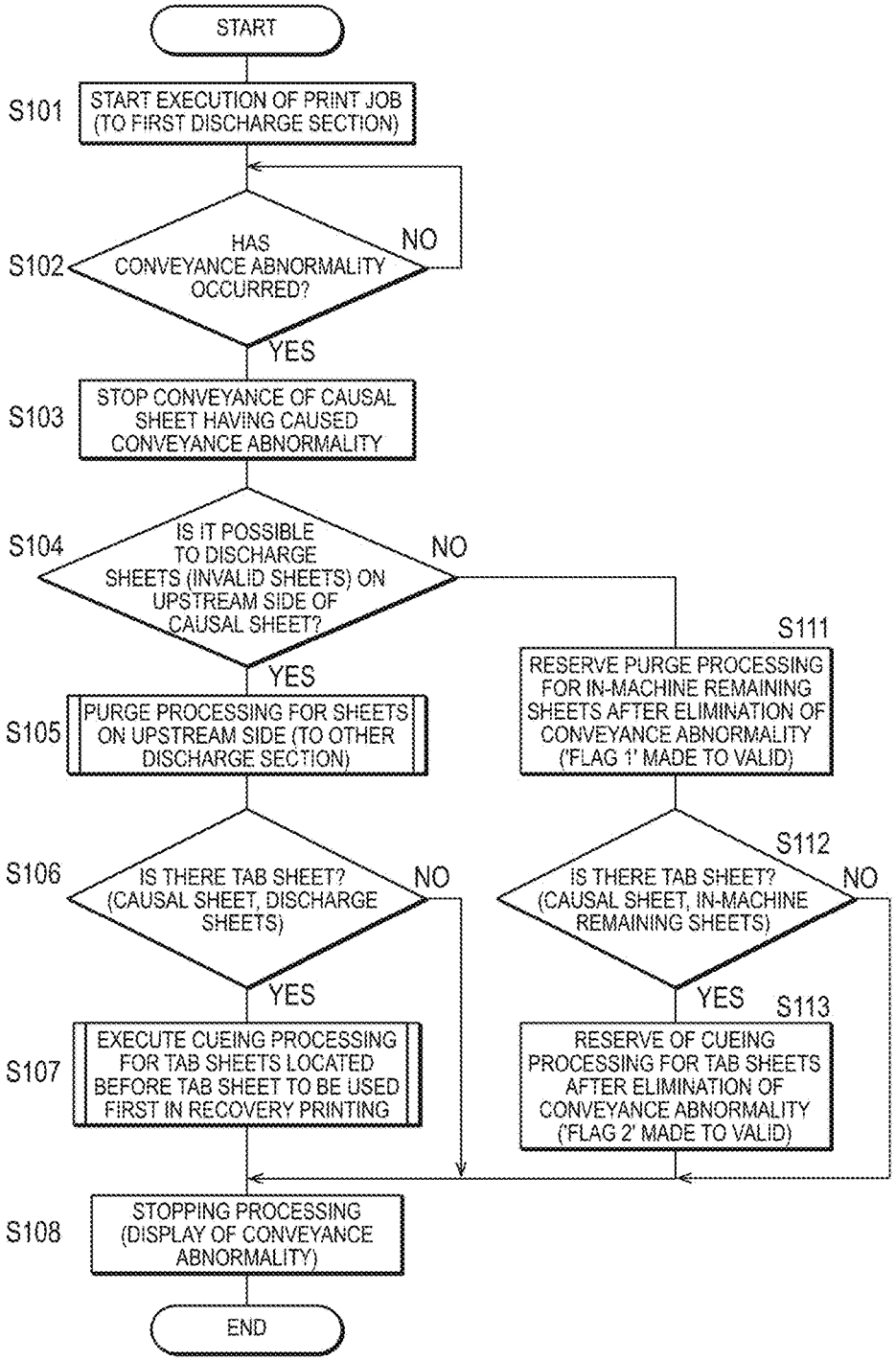
FIG. 7 is a flow chart showing print control executed by the image forming system according to the present embodiment.

FIG. 7 is a flow chart showing print control executed by the image forming system 10 according to the present embodiment. In concrete terms, the processor 110 becomes a main constituent, and executes the print control shown in FIG. 7 cooperatively with the other processors 210, 310, and 410.

First, the processor 110 receives an execution instruction of a print job from a user via a terminal (personal computer) connected with the image forming system 10 through a network or the operation display 170, and then starts execution of the print job (S101).

Herein, in this specification, a sheet feed tray which stores sheets with sequentiality like tab sheets is called "a first sheet feed tray" especially, and a sheet feed tray other than the first sheet feed tray are called "the other sheet feed tray". Moreover, a discharge destination set by print settings is called "a first discharge section" especially, and a discharge section other than the first discharge section is called "the other discharge section". Any sheet feed tray and any discharge section may be used as the first sheet feed tray and the first discharge section, respectively. However, the following description is made on the assumption that "the first sheet feed tray" is the sheet feed tray 161 and "the first discharge section" is the discharge section 491.

In Step S102, whether conveyance abnormality has occurred is determined. In concrete terms, the processor 110 monitors the sheet sensors 140, 240, 340, and 440 disposed on the conveyance passage in the image forming system 10 directly or indirectly via the other processors 210, 310, and 410, and determines whether conveyance abnormality of the sheet S has occurred on the conveyance passage.

Figure 8:
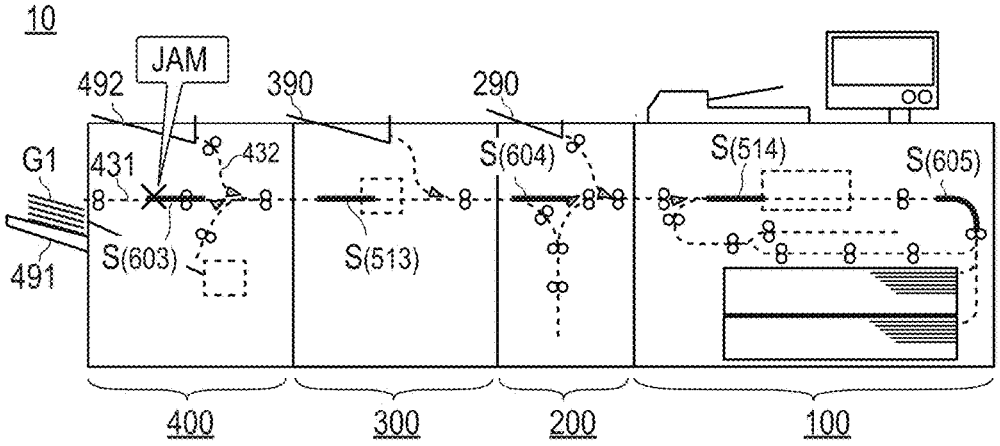
FIG. 8 is an illustration showing a conveyance state of sheets when a conveyance abnormality has occurred.
Figure 9:
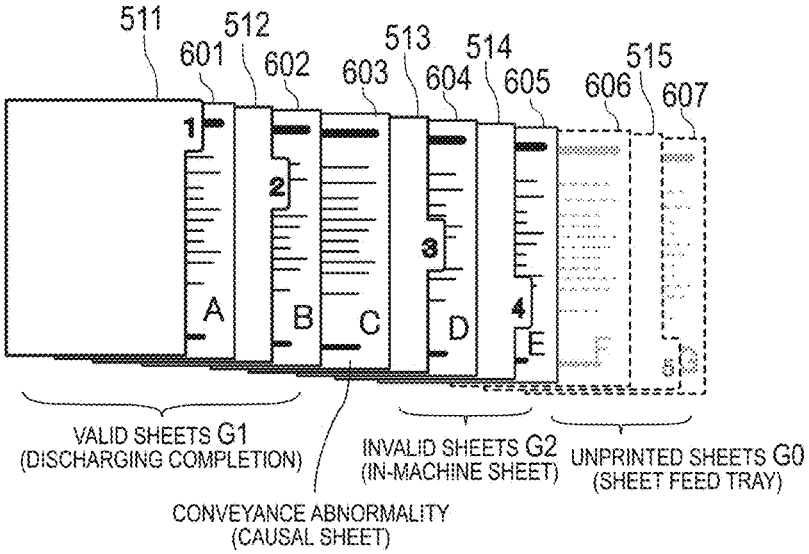
FIG. 9 is an illustration for describing a state of a printed matter when the conveyance abnormality shown in FIG. 8 has occurred.

Hereinafter, operation when conveyance abnormality has occurred is described with reference to FIG. 8 and FIG. 9. FIG. 8 is an illustration showing a conveyance state of sheets when conveyance abnormality has occurred, and FIG. 9 is an illustration for describing a state of a printed matter when the conveyance abnormality shown in FIG. 8 has occurred. Here, the printed matter shown in FIG. 9 corresponds to that shown FIG. 6C.

In the case where, after any of the sheet sensors 140, 240, 340, and 440 has output a signal showing existence of a sheet, the signal has not changed to a signal showing nonexistence of a sheet even if a predetermined timing has elapsed, the processor 110 determines that conveyance abnormality of the sheet S has occurred (S102: YES). FIG. 8 shows a state where conveyance abnormality (a jam) of a sheet 603 (causal sheet) has occurred on the conveyance passage 431 of the binding apparatus 400. At this time, as shown in FIG. 8, on the conveyance passage on the upstream side than the causal sheet, sheets 513, 604, 514, and 605 have been being conveyed.

In the case where conveyance abnormality has occurred on the conveyance passage 431, the sheet conveying section 430 is controlled so as to stop immediately drive of the conveying roller pairs which has be conveying the causal sheet having caused the conveyance abnormality (S103). At this time, on the conveyance passage in the image forming system 10, if there are sheets which have been being conveyed on the conveyance passage on the downstream side than the causal sheet, these sheets are discharged as valid sheets to the first discharge section without any change.

In FIG. 9, sheets 511, 601, 512, and 602 which have been printed earlier than the causal sheet (sheet 603) and conveyed (to the downstream side), are valid sheets G1 having been output normally. On the other hand, sheets 513, 604, 514, and 605 which have been being conveyed on the conveyance passage on the upstream side than the causal sheet when conveyance abnormality has occurred, are invalid sheets G2. Furthermore, sheets 606, 515 and 607 are unprinted sheets G0, and have been stored in the sheet feed tray when conveyance abnormality has occurred.

Now, returning to the description for FIG. 7. In Step S104, the processor 110 determines whether the sheets (invalid sheet G2) on the upstream side of the causal sheet can be discharged to any of the plurality of discharge sections. This determination is mainly based on the position of occurrence of conveyance abnormality. In the example shown in FIG. 8, the stop position of the causal sheet 603 is located on the downstream side than a branch point of the conveyance passage 431 to the conveyance passage 432. In this case, the processor 110 can determine such that the sheet 513 having been being conveyed on the immediately upstream side than the causal sheet 603 and sheets on the upstream side than the sheet 513 can be discharged to the discharge section 492 being the other discharge section other than the first discharge section via the conveyance passage 432 (S104: YES).

In response to this determination, the processor 110 executes purge processing (pre-purge processing) with which sheets (invalid sheet G2) which have been being conveyed on the upstream side than the causal sheet, are discharged to the discharge section 492 (S105 ("the first discharging step")). At the time of this purge processing, it is preferable to control to start discharging the sheets on the upstream side than the causal sheet to the discharge section 492 without having never stopped the sheets or with minimum stopping time.

Successively, in the next step S106, whether a tab sheet is included in the causal sheet or the invalid sheets G2 is determined. In the example shown in FIG. 8 and FIG. 9, since tab sheets (sheets 513 and 514) are included in the invalid sheets G2 (S106: YES), the processing advances to the next processing.

In the next step S107 ("the second discharging step"), among sheets with sequentiality stored in the first sheet feed tray (sheet feed tray 161), sheets located before a sheet to be fed first at the time of performing recovery printing after elimination of conveyance abnormality, are fed out, and discharged to the other discharge section (hereinafter, referred to as a "cueing processing"). Hereinafter, a description is made in more detail with reference to the drawings. Herein, the "recovery printing" is printing performed again based on image data corresponding the sheets (the causal sheet and the invalid sheets) which have become invalid due to conveyance abnormality and the like.

(Cueing Processing)

Figure 10:
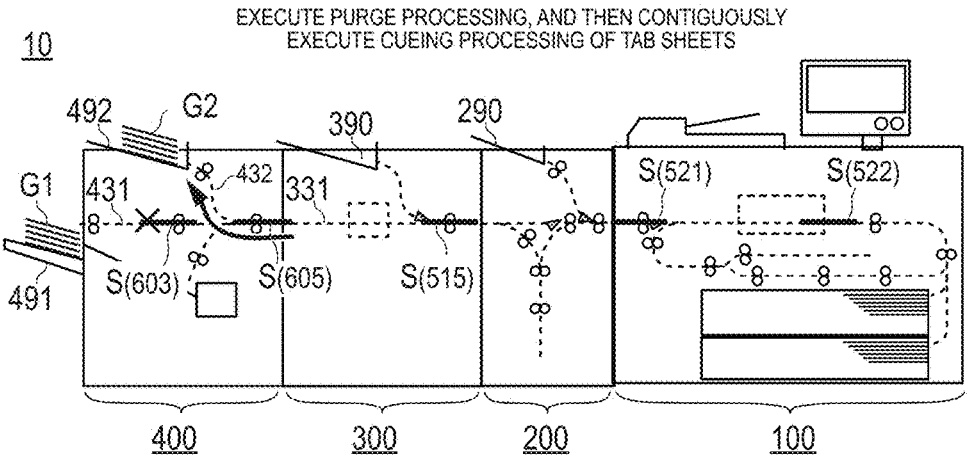
FIG. 10 is an illustration showing a conveyance state of sheets at the time of executing purge processing and cueing processing.
Figure 11A:
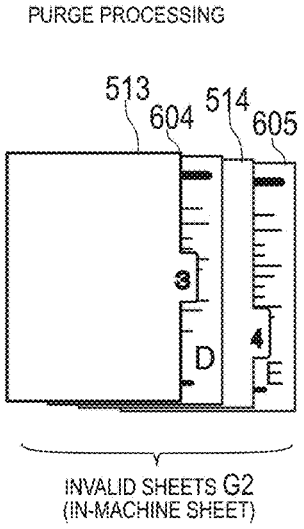
FIGS. 11A, 11B, and 11C each is an illustration for describing a state of tab sheets in association with purge processing and cueing processing.
Figure 11B:
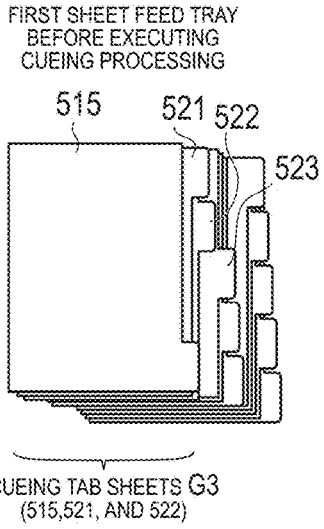
Figure 11C:
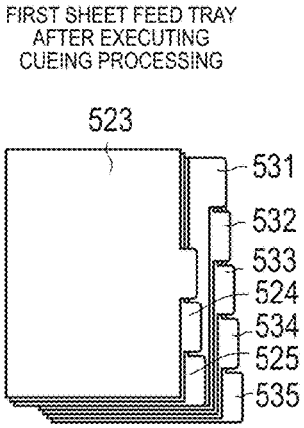

FIG. 10 is an illustration showing a conveyance state of sheets at the time of executing purge processing and cueing processing of tab sheets, and FIGS. 11A to 11C each is an illustration for describing a state of tab sheets in association with the purge processing and the cueing processing. As shown in FIG. 10, the invalid sheets G2 (refer to FIG. 11A) are discharged to the discharge section 492 by the purge processing (S105).

As shown in FIG. 11A, the invalid sheets G2 include the third and fourth sheets 513 and 514 among a sheet set including five tab sheets. At this time, tab sheets stored in the first sheet feed tray (sheet feed tray 161) are exactly as shown in FIG. 11B. The next recovery printing is executed based on the image data corresponding to the sheet 603 and the subsequent sheets shown in FIG. 9. At the time of this recovery printing, among tab sheets stored in the first sheet feed tray, a sheet to be fed first is the third sheet 523 in the next sheet set 52. Then, among the sheets stored at this time point in the first sheet feed tray, it is necessary to remove sheets 515, 521, and 522 as targets of the cueing processing from the first sheet feed tray before starting the recovery printing.

As shown in FIG. 10, the sheets 515, 521, and 522 subjected to the cueing processing in Step S107 follow immediately after the sheet 605 of the invalid sheets G2 subjected to the purge processing (S105). Then, the cueing processing is executed contiguously following the purge processing. Herein, the term "contiguously" means that the cueing processing is executed contiguously after the purge processing without substantial stop. In the viewpoint of early processing, as shown in FIG. 10, it is preferable to control timing such that the first sheet (sheet 515) in the cueing processing follows immediately after the last sheet (sheet 605) in the purge processing.

FIG. 11C is an illustration showing tab sheets stored in the first sheet feed tray after the cueing processing, and at this time, the cueing has been performed such that a tab sheet to be fed first in the recovery printing becomes a sheet 523.

Figure 12:
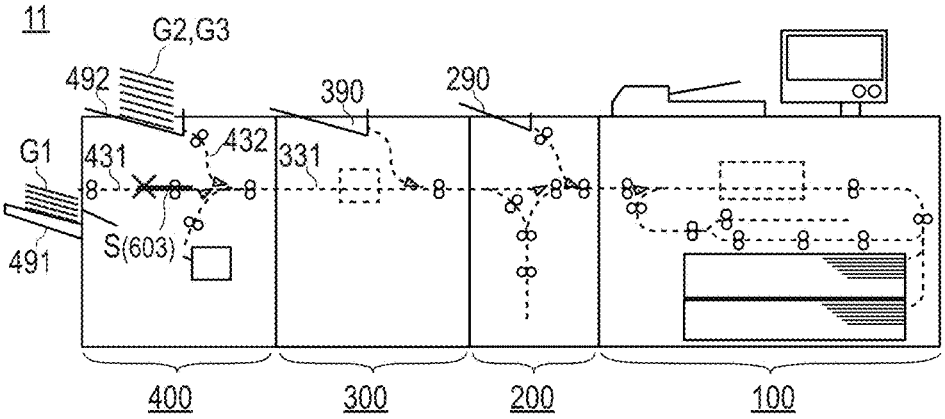
FIG. 12 is an illustration showing a conveyance state of sheets at a time when cueing processing has been completed.

FIG. 12 is an illustration showing a conveyance state of sheets at a time when the cueing processing has been completed, and the respective discharge destinations of the invalid sheets G2 and cueing tab sheets G3 which have become targets of the cueing processing are set to the same discharge section 492.

Now, returning to the description for FIG. 7. After the cueing processing has been completed, stop processing (S108) is executed. At the time of the stop processing, conveyance abnormality relevant information is displayed on the operation display 170. Examples of the conveyance abnormality relevant information include information showing that a jam itself has occurred and image information showing the position of a causal sheet and a removal procedure. At this time, in order to perform recovery printing, data of a print job and an output situation of the print job may be stored in the memory 120.

In the above portion, the description has been given to the print control in the case of executing purge processing before removing a causal sheet. Next, a description is given to print control in the case where purge processing is unable to be performed before removing a causal sheet.

In Step S104 shown in FIG. 7, in the case where the processor 110 has determined such that sheets (invalid sheets G2) on the upstream side of the causal sheet are unable to be discharged to any of the plurality of discharge sections (S104: NO), in the next Step S111, the processor 110 reserve purge processing after elimination of conveyance abnormality. In concrete terms, a "flag 1" is made to valid, and this flag situation is stored in the memory 120. For example, in the case where conveyance abnormality has occurred on the conveyance passage 131 (refer to FIG. 3) on the upstream side upper than the discharge section 290 of the most upstream side, it is determined that sheets on the upstream side of a causal sheet are unable to be discharged to any of the discharge sections.

In the next Step S112, similarly to Step S106, whether a tab sheet is included in the causal sheet or the invalid sheets G2, is determined. In the case where it determines that a tab sheet is included (S112: YES), cueing processing for the tab sheet after elimination of conveyance abnormality is reserved. In concrete terms, a "flag 2" is made to valid, and this flag situation is stored in the memory 120.

Next, stop processing in Step S108 is performed. In the stop processing at this time, the stop processing of the invalid sheets G2 is executed before displaying the above-mentioned conveyance abnormality relevant information. In concrete terms, operation of each of the drive motors in the image forming system 10 is stopped. At this time, the invalid sheets G2 which has not been subjected to purge processing are stopped and made to wait ("waiting step") as in-machine remaining sheet at predetermined waiting positions on the respective conveyance passages in the image forming system 10 in a state capable of being conveyed again with purge processing after elimination of conveyance abnormality, and then the processing ends (End).

(Operation of the Image Forming System 10 in Association with Elimination of Conveyance Abnormality)

Figure 13:
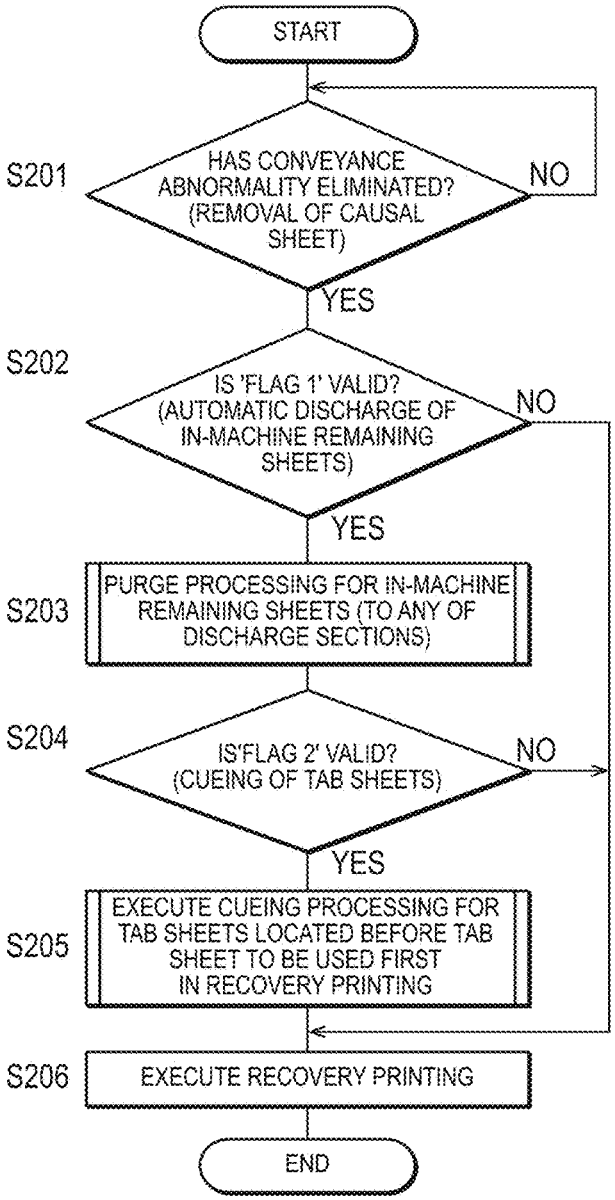
FIG. 13 is a flowchart showing print control executed after the print control shown in FIG. 7.

FIG. 13 is a flowchart showing print control executed by the image forming system 10 according to the present embodiment and executed after the print control shown in FIG. 7. The processor 110 serves as a main constituent, and executes the print control shown in FIG. 13 cooperatively with the other processors 210 to 410.

The processor 110 determines whether conveyance abnormality has been eliminated by a user (S201). For example, in the case where the processor 110 has detected that the causal sheet of the conveyance abnormality has not existed, based on a change of a signal from a sheet sensor which has detected the conveyance abnormality in Step S102 shown in FIG. 7, the processor 110 determines that conveyance abnormality has been eliminated.

Successively, the processor 110 determines whether the "flag 1" with regard to purge processing is valid, and in the case where it is valid (S202: YES), purge processing is executed for the in-machine remaining sheets which have been stopped at the waiting positions on the conveyance passage in Step S108 (S203 ("the third discharging step")).

Next, the processor 110 determines whether the "flag 2" with regard to cueing processing is valid, and in the case where it is valid (S204: YES), cueing processing of tab sheets similar to Step S107 is executed (S205 ("the fourth discharging step")).

The discharge destination in each of the discharging steps in Steps S203 and S205 may be set to any of the discharge sections including the discharge section 491. However, it is preferable to set to the other discharge sections other than the discharge section 491 so as to make it easy to distinguish the invalid sheets and the cueing tab sheets from the valid sheets. After the purge processing and the cueing processing have been executed, the flags 1 and 2 are reset.

Next, in the case where either of the flags 1 and 2 is not valid, or in the case where the cueing processing of tab sheets has been completed, the recovery printing described below is executed (S206).

(Recovery Printing (S206))

Hereinafter, a description is given to recovery processing in the case where a tab sheet is included in the invalid sheets G2 or the causal sheet as shown in FIG. 9. At a time point when recovery processing is started, the tab sheets stored in the sheet feed tray 161 has become a state shown in FIG. 11C by the cueing processing for tab sheets in Step S107 or S205 (the second or fourth discharging step) shown in FIGS. 7 and 13 respectively. Then, recovery printing is executed based on the image data of the print job stored in the memory 120.

Figure 14:
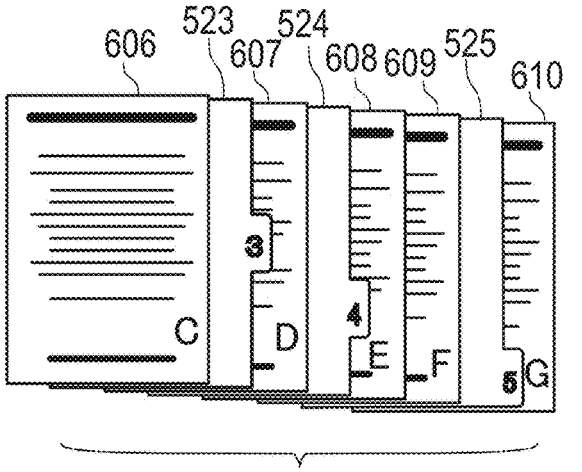
FIG. 14 is an illustration showing an example of a recovery printed matter.

FIG. 14 shows an example of a recovery printed matter G4. The recovery printing is performed based on image data (image data C to G, label image data 3 to 5) corresponding to the causal sheet (sheet 603) and the subsequent sheets shown in FIG. 9. The tab sheets 523, 524, and 525 fed from the sheet feed tray 161 at this time are tab sheets corresponding, in the order, to the tab sheets 513, 514, and 515 included in the invalid sheets G2 and the unprinted sheets G0 shown in FIG. 9. The recovery printed matter G4 is discharged to the first discharge section (discharge section 491) having been set by the print settings, stacked on the valid sheet G1 (refer to FIG. 9) in the discharge section, and become a complete printed matter (refer to FIG. 6C).

(Effect)

In the present embodiment, as described in S101 to S107 shown in FIG. 7, in the case where conveyance abnormality of sheets has occurred on the conveyance passage in course of execution of a print job which uses tab sheets and discharges sheets having been subjected to image formation to a first discharge section of the plurality of discharge sections, conveyance of a causal sheet having caused the conveyance abnormality is stopped, and sheets having been being conveyed on the conveyance passage on an upstream side than the causal sheet are discharged to the other discharge section other than the first discharge section ((pre-purge processing). Thereafter, continuously, sheets located before a sheet to be fed first at the time of recovery printing are fed from the first sheet feed tray, and are discharged to the other discharge section (cueing processing). In this way, since the purge processing and the cueing processing are executed in advance before conveyance abnormality is eliminated, it becomes possible to start immediately recovery printing executed after conveyance abnormality has been eliminated subsequently to the above processing.

Moreover, since the cueing processing is executed in advance, in the case where a shortage of sheets in the first sheet feed tray occurs due to this cueing processing, the shortage can be displayed at the operation display 170 during stopping due to conveyance abnormality. Accordingly, since it is expected that a user executes sheet supply in addition to an elimination work of conveyance abnormality, the subsequent recovery printing can be performed efficiently.

Moreover, as shown in FIG. 12, a discharge destination of the invalid sheets G2 by the purge processing and a discharge destination of the cueing tab sheets G3 by the cueing processing are set to the same discharge section 492 which is different from the discharge section 491 of valid sheets. With this way, a user can distinguish the invalid sheet and the cueing tab sheet which are not used, from valid sheets without getting confused.

Modification Embodiment

Figure 15:
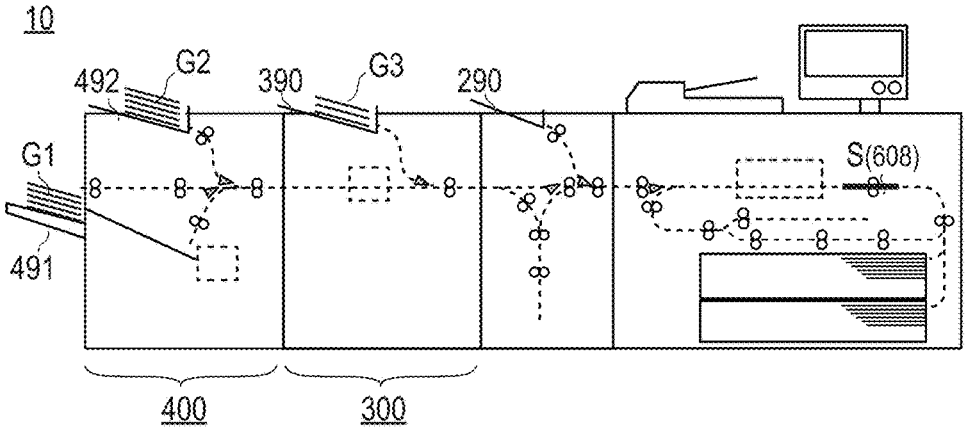
FIG. 15 is an illustration showing a conveyance state of sheets at a time when cueing processing in the first modification embodiment has be completed.

FIG. 15 is an illustration showing a conveyance state of sheets at a time when the cueing processing in the first modification embodiment has been completed. In an embodiment shown in FIG. 15, a discharge destination of the invalid sheets G2 by the purge processing is set to the discharge section 492, and a discharge destination of the cueing tab sheets G3 by the cueing processing is set to the discharge section 390.

The first modification embodiment is effective especially in the case of reusing tab sheets. Since the cueing tab sheets G3 has not been used, a discharge destination of them is set to a different discharge destination from that of the invalid sheets G2, whereby the cueing tab sheets G3 can be separated easily.

Moreover, as in the first modification embodiment, in the case where a discharge destination of the invalid sheets G2 by the purge processing and a discharge destination of the cueing tab sheets G3 by the cueing processing are set respectively to the discharge section 492 and the discharge section 390 which adjoin each other, handling at the time of removing both the invalid sheets G2 and the cueing tab sheets G3 becomes easy.

A discharge destination of the invalid sheets G2 needs to be set to a discharge section located on the immediately upstream side of the stop position of the causal sheet. However, a discharge destination of the cueing tab sheets G3 has a comparatively high degree of freedom. Namely, in the case where the causal sheet stops at a position shown in FIG. 8, a discharge destination of the cueing tab sheets G3 may be set to any of the discharge sections 290, 390, and 492. For this reason, the discharge destination of the cueing tab sheets G3 may be set to the discharge section 290 located on the most upstream side. In the case of reusing the cueing tab sheets G3, the discharge destination of the cueing tab sheets G3 set to nearer the image forming apparatus 100 (sheet feed tray) makes handling easy.

Other Modification Embodiment

In the present embodiment mentioned above, a sheet set including tab sheets is used as a sheet set including a plurality of sheets with sequentiality. However, the other sheets may be also used. For example, follow-up printing sheets in which a different content has been printed for each sheet beforehand, may be used as a sheet set. Alternatively, a sheet set in which different color sheets are aligned sequentially, may be also used.

Moreover, in the present embodiment mentioned above, the description has been given on the assumption that the image forming system 10 includes the image forming apparatus 100, the inversion conveyance apparatus 200, the folding apparatus 300, and the binding apparatus 400. However, the present invention should not be limited to the above constitution. The image forming system 10 may include other apparatus other than above apparatuses. Alternatively, a part of the above apparatuses may not be included.

Figure 16:
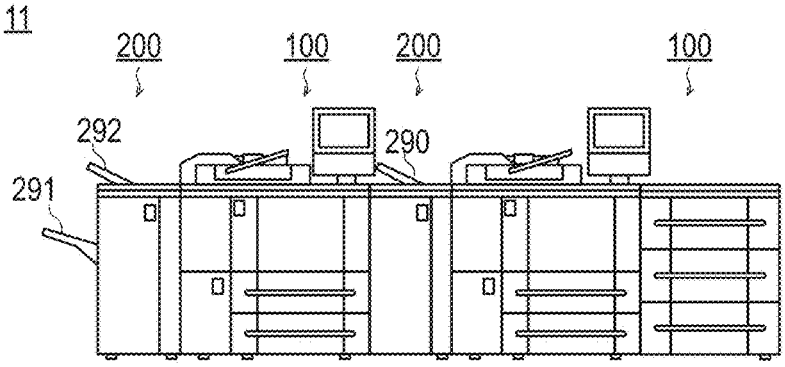
FIG. 16 is a front view showing an external appearance of an image forming system according to the second modification embodiment.

FIG. 16 shows the second modification embodiment in which two image forming apparatuses 100 are linked, and an inversion conveyance apparatus 200 is disposed between the two image forming apparatuses 100. In FIG. 16, three discharge sections 290, 291, and 292 are disposed. Such an image forming system 11 may be employed as the present embodiment.

Moreover, in the present embodiment mentioned above, the description has been given on the assumption that each of the apparatuses such as the image forming apparatus 100 is disposed as a separate body. However, the present invention should not be limited to the above constitution. The respective apparatuses may be constituted as one body. Alternatively, each of the apparatuses may be incorporated in the other apparatus. For example, the respective processing sections of the other apparatuses, such as the inverting section 250, the folding section 350, and the binding section 450 may be incorporated in the image forming apparatus 100. Alternatively, the post processing apparatus which includes a plurality of post processing functions, such as inversion conveyance, punching processing, saddle stitching, and side stitching, may be applied to the image forming system 10.

Furthermore, programs which makes the image forming system 10 operate may be provided by a computer readable storage medium, such as a USB memory, a flexible disk, a CD-ROM, or may be provided via on-line through networks, such as Internet. In this case, the programs stored in the computer-readable storage medium are usually transferred to a memory, a storage, etc., and are stored in them. Furthermore, the programs may be provided, for example, as independent application software, or may also be incorporated in software of each apparatus as one function of the image forming system 10.

What is claimed is:

1. An image forming system, comprising:

a sheet feeding section which includes a plurality of sheet feed trays each of which stores a plurality of sheets, and feeds sheets stored in the sheet feed tray one sheet by one sheet;

a conveyance section which includes a conveyance passage, and conveys a sheet fed from the sheet feeding section on the conveyance passage;

an image forming section which forms an image on a conveyed sheet;

a plurality of discharge sections each of which discharges a sheet having been subjected to image formation; and a processor configured such that in a case where a plurality of sheet sets each including a plurality of sheets with sequentiality are stored in a first sheet feed tray of the plurality of sheet feed trays, and in a case where conveyance abnormality of a sheet has occurred on the conveyance passage in course of execution of a print job which uses sheets included in the sheet set and discharges a sheet having been subjected to image formation to a first discharge section of the plurality of discharge sections, the processor stops conveyance of a causal sheet having caused the conveyance abnormality, and discharges sheets having been being conveyed on the conveyance passage on an upstream side than the causal sheet to other discharge section other than the first discharge section, and thereafter, continuously, the processor feeds sheets located, in the sheet set, before a sheet to be fed first at a time of performing recovery printing after elimination of conveyance abnormality, from the first sheet feed tray, and discharges the sheets to the other discharge section.

2. The image forming system as claimed in claim 1, wherein in a case where the sheets having been being conveyed on the conveyance passage on an upstream side than the causal sheet are unable to be discharged to the other discharge section when the conveyance abnormality has occurred, the processor makes the sheets having been being conveyed on the conveyance passage on an upstream side wait on the conveyance passage, and discharges the sheet made to wait on the conveyance passage to any of the plurality of discharge sections after the causal sheet has been removed by a user, and thereafter, the processor feeds sheets located, in the sheet set, before a sheet to be fed first at a time of performing recovery printing from the first sheet feed tray, and discharges the sheets to any of the plurality of discharge sections.

3. The image forming system as claimed in claim 1, wherein the other discharge section includes two or more other discharge sections, and the processor sets a discharge destination of sheets having been being conveyed on the conveyance passage on the upstream side than the causal sheet and a discharge destination of sheets which have been located, in the sheet set, before a sheet to be fed first at a time of performing recovery printing and fed from the first feeding sheet tray, to the same discharge section among the other discharge sections.

4. The image forming system as claimed in claim 1, wherein the other discharge section includes two or more other discharge sections, and the processor sets a discharge destination of sheets having been being conveyed on the conveyance passage on the upstream side than the causal sheet and a discharge destination of sheets which have been located, in the sheet set, before a sheet to be fed first at a time of performing recovery printing and fed from the first feeding sheet tray, to respective different discharge sections among the other discharge sections.

5. The image forming system as claimed in claim 4, wherein the processor sets a discharge destination of sheets which have been located, in the sheet set, before a sheet to be fed first at a time of performing recovery printing and fed from the first feeding sheet tray, to a discharge section on the most upstream side among the plurality of discharge sections.

6. The image forming system as claimed in claim 4, wherein the processor sets a discharge destination of sheets having been being conveyed on the conveyance passage on the upstream side than the causal sheet and a discharge destination of sheets which have been located, in the sheet set, before a sheet to be fed first at a time of performing recovery printing and fed from the first feeding sheet tray, to respective different discharge sections which adjoin each other among the other discharge sections.

7. A control method for an image forming system which includes a sheet feeding section which includes a plurality of sheet feed trays each of which stores a plurality of sheets, and feeds sheets stored in the sheet feed tray one sheet by one sheet, a conveyance section which includes a conveyance passage, and conveys a sheet fed from the sheet feeding section on the conveyance passage, an image forming section which forms an image on a conveyed sheet, and a plurality of discharge sections each of which discharges a sheet having been subjected to image formation, the control method comprising:

a printing step of executing a print job, wherein a plurality of sheet sets each including a plurality of sheets with sequentiality are stored in a first sheet feed tray of the plurality of sheet feed trays, and the print job uses sheets included in the sheet set and discharges a sheet having been subjected to image formation to a first discharge section of the plurality of discharge sections;

a detecting step of detecting conveyance abnormality of a sheet on the conveyance passage in course of execution of the print job;

a first discharging step of, in a case of detecting the detecting conveyance, stopping conveyance of a causal sheet having caused the conveyance abnormality, and discharging sheets having been being conveyed on the conveyance passage on an upstream side than the causal sheet to other discharge section other than the first discharge section; and a second discharging step of, continuously following to the first discharging step, feeding sheets located, in the sheet set, before a sheet to be fed first at a time of performing recovery printing after elimination of conveyance abnormality, from the first sheet feed tray, and discharging the sheets to the other discharge section.

8. A non-transitory computer-readable storage medium storing a control program for causing an image forming system to execute a process, wherein the image forming system includes a sheet feeding section which includes a plurality of sheet feed trays each of which stores a plurality of sheets, and feeds sheets stored in the sheet feed tray one sheet by one sheet, a conveyance section which includes a conveyance passage, and conveys a sheet fed from the sheet feeding section on the conveyance passage, an image forming section which forms an image on a conveyed sheet, and a plurality of discharge sections each of which discharges a sheet having been subjected to image formation, the process comprising:

a printing step of executing a print job, wherein a plurality of sheet sets each including a plurality of sheets with sequentiality are stored in a first sheet feed tray of the plurality of sheet feed trays, and the print job uses sheets included in the sheet set and discharges a sheet having been subjected to image formation to a first discharge section of the plurality of discharge sections;

a detecting step of detecting conveyance abnormality of a sheet on the conveyance passage in course of execution of the print job;

a first discharging step of, in a case of detecting the detecting conveyance, stopping conveyance of a causal sheet having caused the conveyance abnormality, and discharging sheets having been being conveyed on the conveyance passage on an upstream side than the causal sheet to other discharge section other than the first discharge section; and a second discharging step of, continuously following to the first discharging step, feeding sheets located, in the sheet set, before a sheet to be fed first at a time of performing recovery printing after elimination of conveyance abnormality, from the first sheet feed tray, and discharging the sheets to the other discharge section.

9. The non-transitory computer-readable storage medium as claimed in claim 8, wherein in a case where the sheets having been being conveyed on the conveyance passage on an upstream side than the causal sheet are unable to be discharged to other discharge section when the conveyance abnormality has detected in the detecting step, a waiting step of waiting the sheets having been being conveyed on the conveyance passage on an upstream side, on the conveyance passage is executed in place of the first discharging step, then, after the causal sheet has been removed by a user, a third discharging step of discharging the sheet made to wait on the conveyance passage to any of the plurality of discharge sections is executed, and thereafter, a fourth discharging step of feeding sheets located, in the sheet set, before a sheet to be fed first in the sheet set at a time of performing recovery printing from the first sheet feed tray, and discharging the sheets to any of the plurality of discharge sections is executed.

* * * * *